US006185880B1

(12) United States Patent
Richardson

(10) Patent No.: US 6,185,880 B1
(45) Date of Patent: Feb. 13, 2001

(54) ROOF VENTILATION

(75) Inventor: Christopher Richardson, Clitheroe (GB)

(73) Assignee: Ultraframe (UK) Limited, Clitheroe (GB)

( * ) Notice: Under 35 U.S.C. 154(b), the term of this patent shall be extended for 0 days.

(21) Appl. No.: 09/139,848

(22) Filed: Aug. 25, 1998

(30) Foreign Application Priority Data

Dec. 4, 1997 (GB) ..... 9725615
Mar. 27, 1998 (GB) ..... 9806558

(51) Int. Cl.[7] ..... E04B 7/00; F24F 7/02

(52) U.S. Cl. ..... 52/198; 52/302.3; 454/364; 454/365

(58) Field of Search ..... 52/198, 199, 302.1, 52/302.3, 57; 454/365, 364, 354, 185

(56) References Cited

U.S. PATENT DOCUMENTS

| | | | | |
|---|---|---|---|---|
| 4,201,121 | * | 5/1980 | Brandenburg, Jr. | 454/365 X |
| 4,616,560 | * | 10/1986 | Esposito | 52/198 X |
| 4,624,084 | * | 11/1986 | Esposito | 52/173.3 |
| 4,951,480 | | 8/1990 | Brence . | |
| 6,000,176 | * | 12/1999 | Lancaster | 52/198 |

FOREIGN PATENT DOCUMENTS

| | | | | |
|---|---|---|---|---|
| 1604185 | | 9/1970 | (DE) . | |
| 3028860 | * | 2/1982 | (DE) | 52/199 |
| 288020 | * | 10/1988 | (EP) | 454/365 |
| 840069A1 | | 5/1998 | (EP) . | |
| 2289766 | | 5/1976 | (FR) . | |
| 2701279 | | 8/1994 | (FR) . | |
| 1156635 | | 7/1969 | (GB) . | |
| 1488504 | | 10/1977 | (GB) . | |
| 2101654A | | 1/1983 | (GB) . | |
| 2213926A | | 8/1989 | (GB) . | |
| 2235281A | | 2/1991 | (GB) . | |
| 2235282A | | 2/1991 | (GB) . | |
| 2266545A | | 11/1993 | (GB) . | |
| WO 98/12484 | | 3/1998 | (WO) . | |

OTHER PUBLICATIONS

Search report from Great Britain Patent Application No. 9826002.9, Feb. 1, 1999.

Search report from International (PCT) Application No. PCT/GB98/02695.

Derwent abstracts (in English) for FR 2,701,279, FR 2,289,766, and EP 840,069A1.

* cited by examiner

*Primary Examiner*—Laura A. Callo
(74) *Attorney, Agent, or Firm*—Rockey, Milnamow & Katz, Ltd.

(57) ABSTRACT

A roof ventilation system, especially for a conservatory roof, comprises a cowl (22) attachable to a ridge component of the roof and an electrically operated rotor (24) within the cowl.

23 Claims, 14 Drawing Sheets

ROOF VENTILATION

This invention concerns roof ventilation in particular conservatory roof ventilation.

Conservatories are popular and attractive additions to many buildings including private houses, hotels and restaurants. Because of the large window area of conservatories, they can become very hot in summer and in winter condensation can be a problem. To mitigate against these conditions and for comfort generally it is desirable to have conservatories well ventilated and indeed to provide conservatories with forced ventilation. However, it is also desirable that any forced ventilation system not be obtrusive.

It is known to provide a vertical axis ventilation fan with radial blades mounted within a conversatory roof ridge beam. This type of fan is unsuitable for forcing air through the very restricted outlet available through a ridge beam. Thus, the arrangement is not particularly efficient at moving air or creating air flow in other than a localised area.

An object of this invention is to provide an improved ventilation system, especially a ventilation system suitable for conservatory roofs.

According to this invention there is provided a roof ventilation system, especially suitable for a conservatory roof, the system comprising a cowl attachable to a ridge component of the roof an electrically operated rotor within the cowl, preferably arranged to rotate on a generally horizontal axis.

The ventilation system of the invention preferably also comprise an apertured cover concealing the rotor from below. The cover is preferably in the form of a grill, preferably with apertures in the form of slots. The apertured cover is preferably attachable to undercladding for the ridge, preferably over an opening formed therein. The cover may also have side apparatus to increase air flow.

The preferred cowl locates the rotor in an offset position relative to a roof ridge and has sides extending above the rotor that may be provided with means for attaching the cowl to the underside of a ridge member. Alternatively or additionally at either or both ends of the cowl attachment points may be provided for positive fixing of the cowl to a ridge member.

A preferred ventilation system of the invention is suitable for use with a roof ridge of the type described in our copending GB Patent Application No. 2310870A, which has an apertured base, side walls extending upwardly from the base and flanges extending downwardly and away from the base. On the underside of the base is a pair of spaced parallel ribs with inwardly directed lips to provide a slot for receiving a component of a ridge cap hold-down system. These ribs provide a convenient location for attachment of the cowl. Such an attachment location could, of course, be provided on any other suitable form of ridge member. The cowl preferably has pairs of spaced outwardly directed barbs to locate on the lips of the ribs on the underside of the base of the ridge beam.

The attachment points for positive fixing of the cowl to a ridge member may be screw holes provided in end extensions of the cowl. The screw holes may be through thicker sections that fit between the ribs on the underside of the ridge member or separate spacers may be provided on the screws, such as of rubber or foam rubber, to provide cushioning and possibly noise reduction while the ventilation system is operating.

Another form of positive fixing for the cowl may comprise pairs of formations on end extensions of the cowl that locate on the underside of a ridge member and wedges for insertions between said formations to urge them outwards to hold them in place.

Another form of positive fixing for the cowl may comprise rotatable clips on end extensions of the cowl that can be turned through 90° to locate in formations on the underside of the ridge member.

As another alternative means of fixing the cowl to the underside of a ridge member, especially for ridge members not having any suitable attachment points, a mounting plate may be fixed on the underside of the ridge member, such as by means of screws, and the cowl of the ventilation systems be provided with means for locating same on the mounting plate. The mounting plate could have a pair of facing grooves to receive tongue formations of the cowl in a sliding fashion. Alternatively, the mounting plate could have shaped formations to snap-fit into or onto correspondingly shaped formations of the cowl.

Above the ridge beam a ridge capping is usually provided, which has sides partially overlying roof glazing. Preferably, when the cowl is mounted to the ridge beam, an air deflector will be mounted on the underside of the ridge capping to direct air towards side edges of the capping. A preferred deflector present a pair of concave arcuate surfaces either side of a ridge.

Alternatively, the cowl may be attachable to a ridge capping on its underside. A preferred ridge capping has formations on its underside, with which cooperating formations of the cowl can engage. The formations of the ridge capping preferably comprising facing L-shaped ribs. The cowl for the rotor can have a pair of upstands with outwardly projecting ends that be clipped onto the L-shaped ribs. Such an arrangement may be enhanced by use of a wedge between the upstands to urge them apart, or by a screw through a cowl part into the ridge capping, especially an extruded screw port thereof. Alternatively, the cowl can have a pivotable T-bolt, which in one orientation can fit between the L-shaped formations before being turned through 90° C. to be retained by the L-shaped formations. Another alternative comprises ball and socket connectors, one or other being provided, preferably in pairs, on the underside of the ridge cladding and the other being provided on the fan cowl.

For attachment of the cover of a preferred ventilation system of the invention to undercladding of a ridge, the cover may have formations that clip over sides of an opening in the undercladding.

Alternatively the cover may be attached to the undercladding to either side of an opening therein, such as by means of screws preferably through the undercladding into screw holes provides in formations of the cover.

In yet another preferred embodiment, the cover for the ventilation system serves also as the ridge undercladding and locates directly onto a ridge member.

The rotor of the ventilation system may be provided with means for automatic operation dependent on temperature. Said means may include variable speed control. The rotor may be battery or mains operated.

The ventilation system of the invention may be used in roof ridges of any pitch and may also be used on half ridges i.e. of lean-to type conservatories.

This invention will now be further described, by way of example only, with reference to the accompanying drawings, in which.

Figure 1:
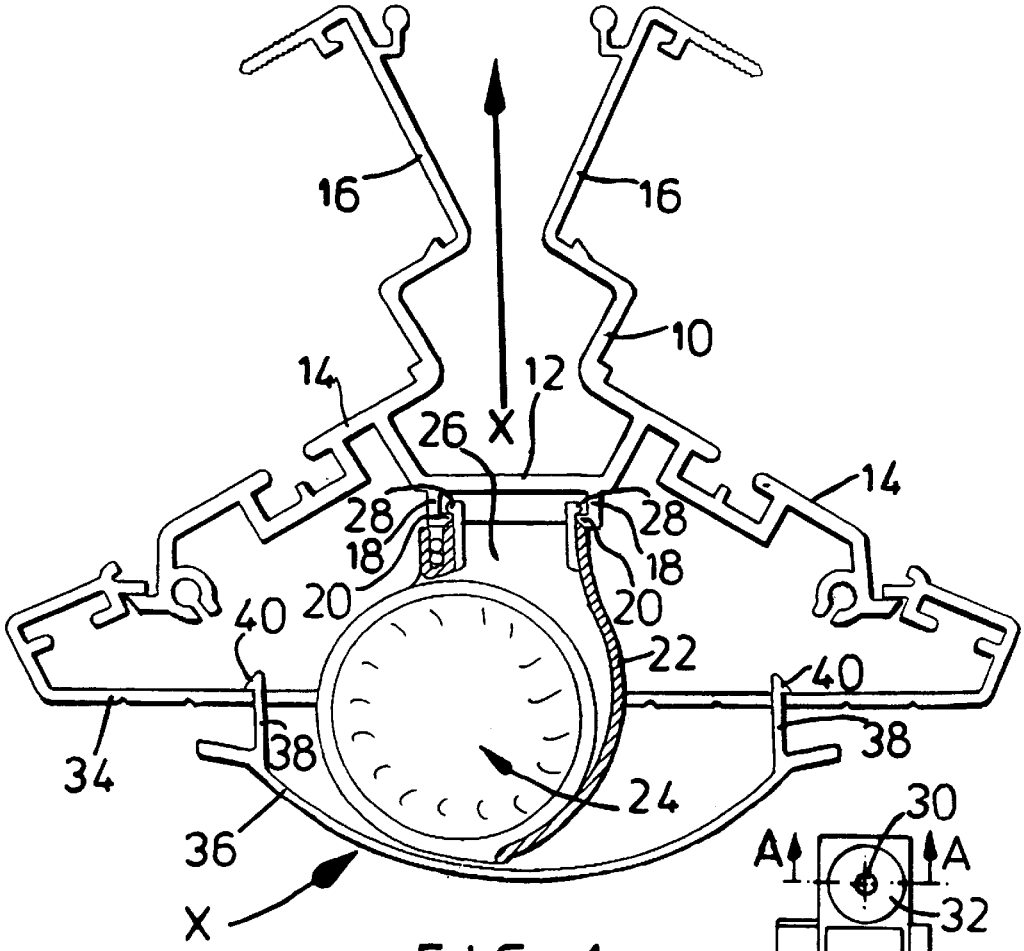
FIG. 1 is a section through a conservatory roof ridge with a ventilation system according to the invention.

Referring to FIGS. 1 to 4 of the accompanying drawings, a ridge beam 10 for a conservatory roof has an apertured base 12, from which extend downwardly and outwardly flanges 14 onto which glazing bars and glazing material (not shown) are mounted. Side walls 16 extend upwardly from the base and have formations for location of a ridge cover (not shown) thereon. On the underside of the base 12 are a pair of spaced parallel ribs 18 with inwardly directed lips 20.

A cowl 22 for an electrically operated fan rotor 24 has a top opening 26 with pairs of spaced bars 28 along its top edges, which barbs clip onto the lips 20 on the underside of the ridge beam 10. The rotor rotates on a horizontal axis lengthwise of the ridge beam. At each end of the cowl extending beyond the opening, the cowl has screw fixing positions 30 for direct fixing of the cowl to the ridge beam. The positions 30 have thicker formations 32 around them to locate between the ribs 18.

Attached to the ends of the flanges 14 is an undercladding 34. To accommodate the rotor/cowl, the undercladding is cut away and a grill cover 36 attached to conceal the rotor/cowl but provide air passageways. The cover 36 is generally accurate and has spaced inwardly from sides of the cover upstanding ribs 38 with lips 40 to clip over edges of the cut away part of the undercladding.

Air flow through the ventilation system is indicated by arrows X.

Figure 3:
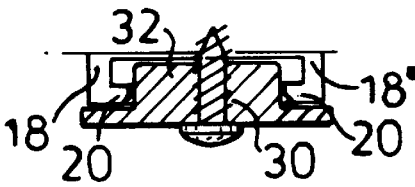
FIG. 3 is a section on line AA of FIG. 2.
Figure 5:
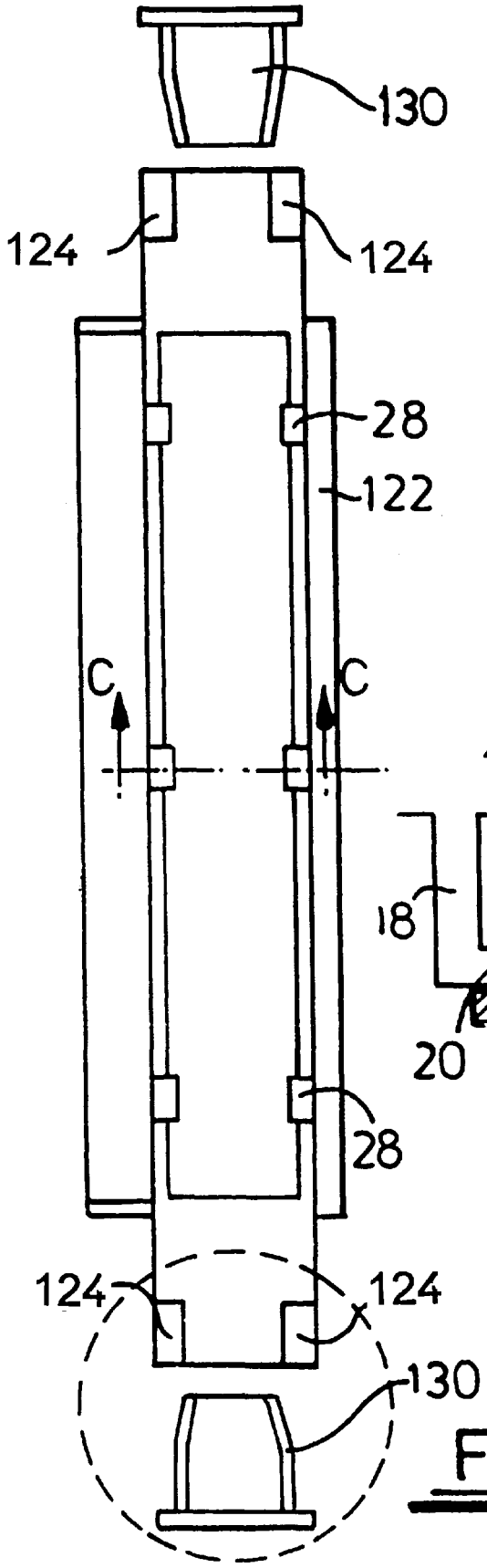
FIG. 5 is a top plan view of another cowl for a ventilation system of FIG. 1.
Figure 6:
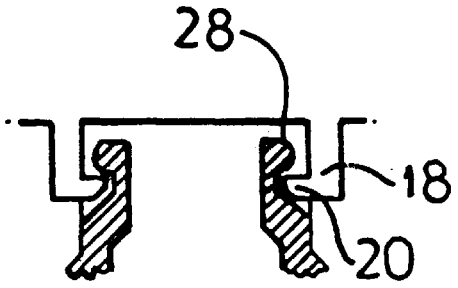
FIG. 6 is a section on line CC of FIG. 5.
Figure 7:
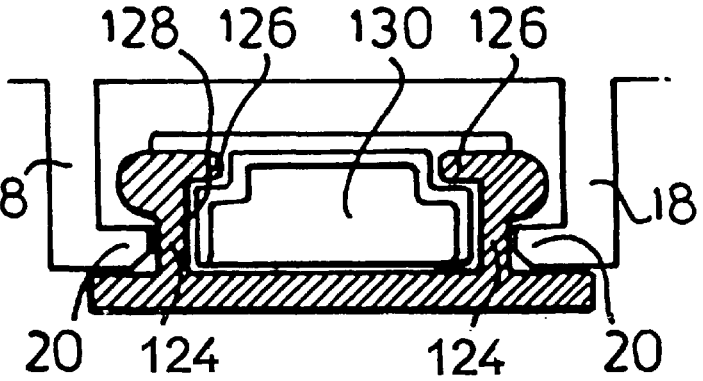
FIG. 7 is an enlarged sectional view of end detail of the grill cover of FIG. 5.

In the following description of FIGS. 5 to 12 and 16 to 19, the ridge beam is as described with reference to FIG. 1. In FIGS. 5 to 7, there is shown a variation on positive attachment of the cowl to the ridge beam. Instead of screw fixing as shown in FIGS. 2 and 3, at each end of cowl 122 are a pair of lugs 124, which are slotted outwardly so as to provide a clip fit onto the lips 20 of the ribs 18 on the underside of the ridge beam in the same way as the barbs 28. The lugs 124 also have inwardly facing lips 126 so as to form a channel 128 to receive a wedge 130. The wedge has divergent sides towards its intended outer end and is rebated along its top edges to fit the channel and exert outward pressure on the lugs when pushed into the channel. In that way the cowl can be secured in place on the ridge beam.

Figure 8:
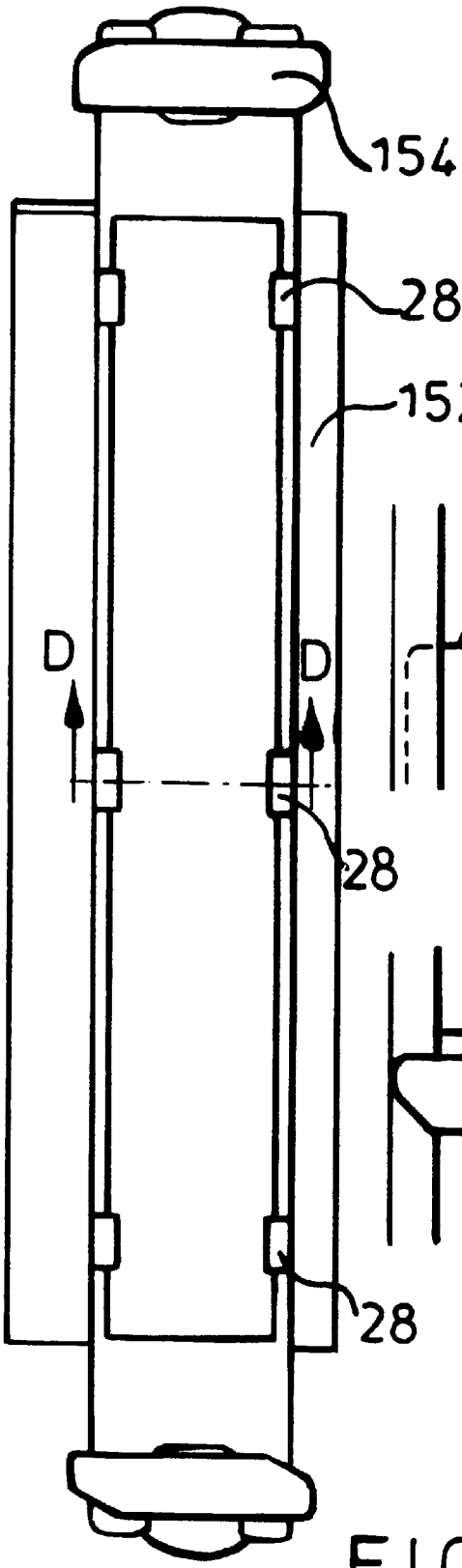
FIG. 8 is a top plan view of yet another cowl for a ventilation system of FIG. 1.
Figure 9:
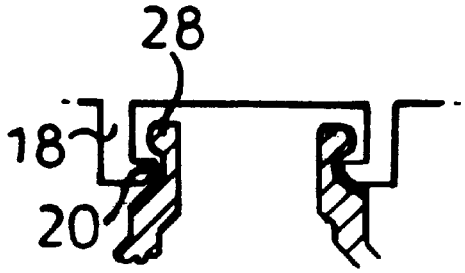
FIG. 9 is a section on line DD of FIG. 8.
Figure 10:
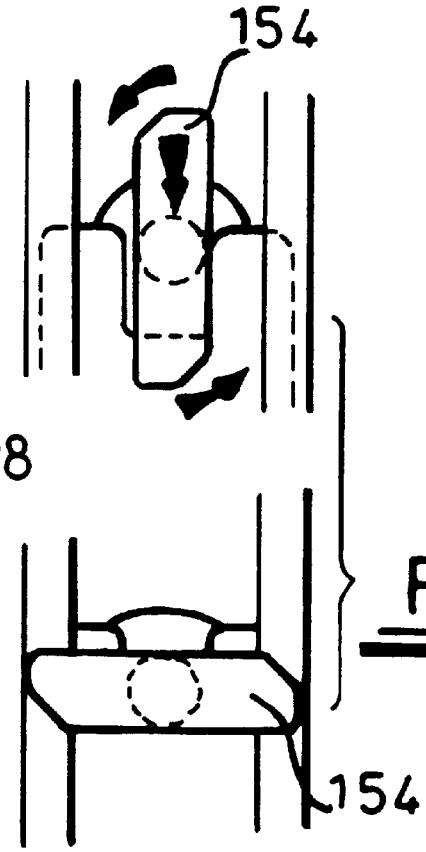
FIG. 10 shows detail of a fixing system for the grill cover of FIG. 8.

Turning to FIGS. 8 to 10 of the accompanying drawings, another form of secure fixing for a cowl 152 is shown. The cowl 152 has at each end a rotatable locking plate 154, which is spaced from the top edge of the cowl. The plate 154 is aligned with the cowl for attachment of the cowl to a ridge beam by means of the barbs 28. Then the locking plate is rotated through 90° so that its ends locate over the lips 20 of the ribs 18 on the underside of the ridge beam. The ends of the plate 154 are shaped to provide camming surfaces to accommodate any variations in spacing of the ribs 18.

Figure 4:
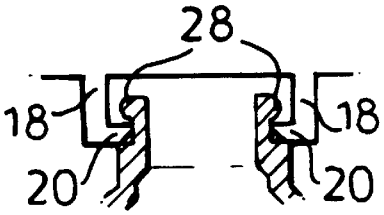
FIG. 4 is a section on line BB of FIG. 2.
Figure 11:
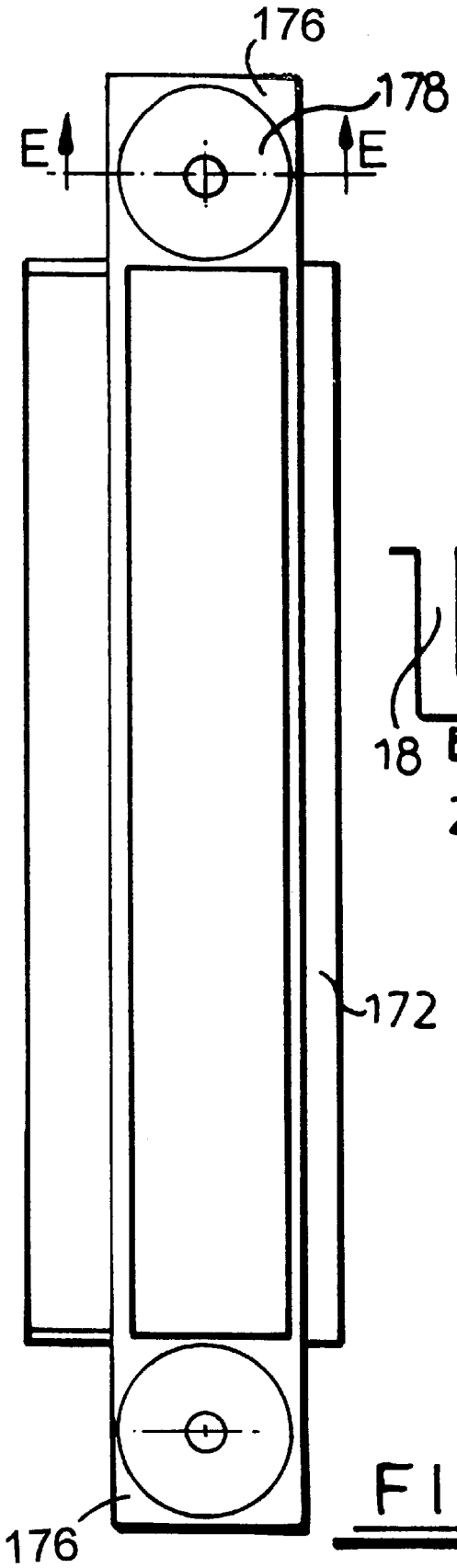
FIG. 11 is a top plan view of a yet further cowl for a ventilation system as shown in FIG. 1.
Figure 12:
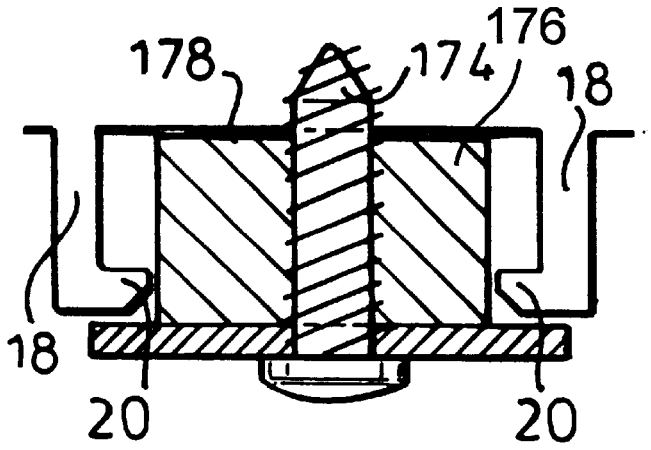
FIG. 12 is a section on line EE of FIG. 11.

In FIGS. 11 and 12 of the accompanying drawings a variation on FIGS. 2 to 4 is shown in which the barbs 28 are omitted and the cowl 172 is simply secured to the ridge beam 10 by screws 174 through end extension 176 of the cowl. Between the end extensions of the cowl and the ridge beam 10 are interposed rubber or foam spacers 178. The spacers may be used to space the cowl from the ridge beam and to act as a cushion in order to reduce noise from operation of the ventilation system.

Figure 13:
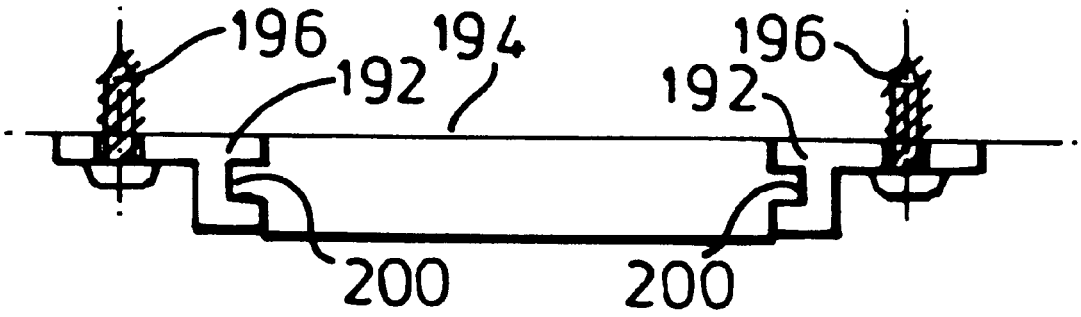
FIGS. 13 and 14 show an alternative means of fixing a cowl for a ventilation system to a roof ridge.
Figure 14:
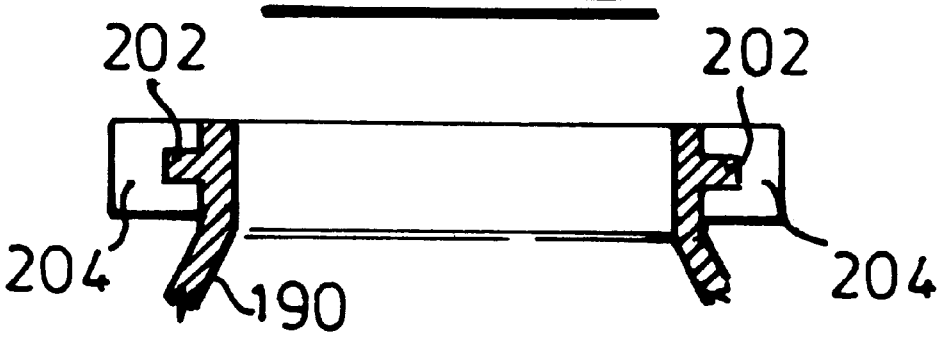

Another means of fixing a cowl 190 of a ventilation system to a ridge beam is shown in FIGS. 13 and 14. In this a mounting plate 192 is attached to the underside of a ridge beam 194 by means of screws 196. The mounting plate has sides 198 with longitudinal grooves 200 facing each other to receive tongues 202 on the sides of the cowl 190 in sliding fashion. At one end of the cowl are stops 204 to abut against the mounting plate when the cowl is in position.

Figure 15:
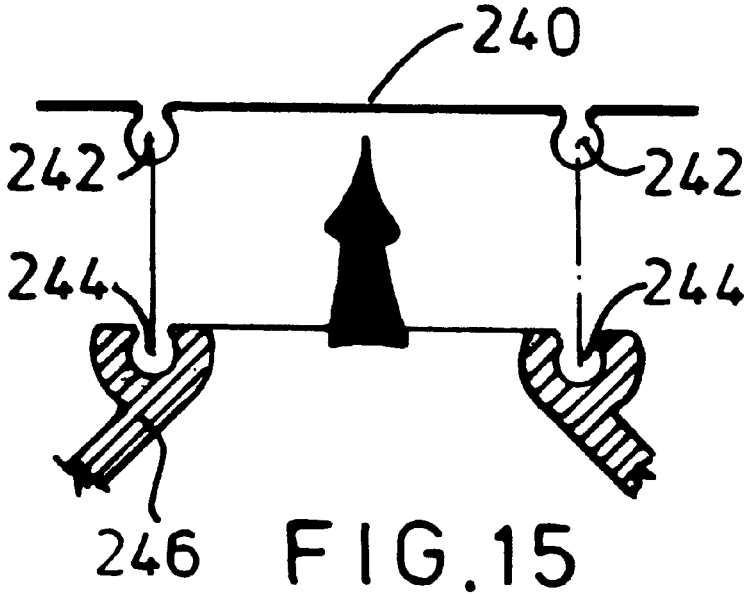
FIG. 15 shows another alternative means of fixing a cowl for a ventilation system of a roof ridge.

In FIG. 15 of the drawings, a mounting plate 240 can be secured to the underside of a ridge beam. The mounting plate 240 has a pair of spaced parallel ribs 242 shaped in section to snap into correspondingly shaped slots 244 of the top edges of a cowl 246 for a ventilation system.

Figure 2:
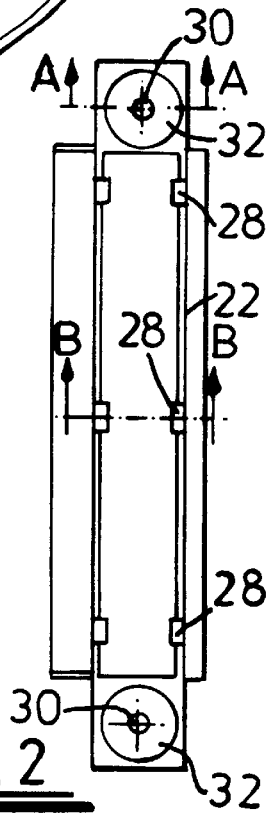
FIG. 2 is a top plan view of a cowl of the ventilation system shown in FIG. 1.
Figure 16:
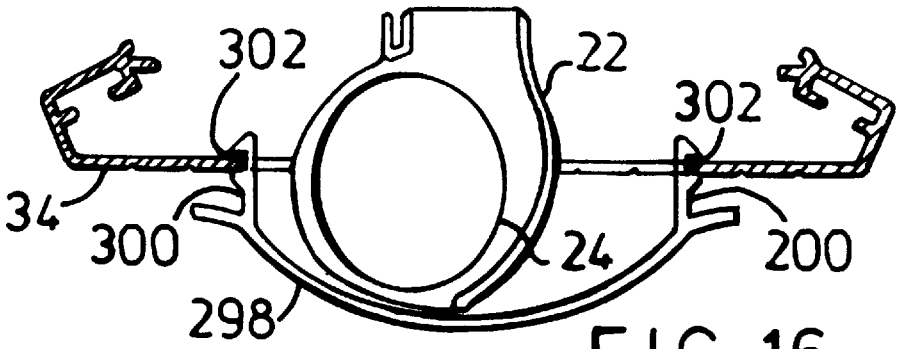
FIG. 16 is an end view of a ventilation system of the invention showing fixing of a grill cover therefor.

FIGS. 16 to 19 of the accompanying drawings are concerned with variations on the means of attaching a grill cover 298 for the ventilation system shown in FIG. 1. In FIG. 16, instead of simple lips on upstanding ribs, ribs 300 have longitudinal slots 302 which locate the grill cover on the side edges of the opening in the ridge undercladding. Additionally, apertures (not shown) are formed in the ribs 300 to provide extra air flow passages.

Figure 17:
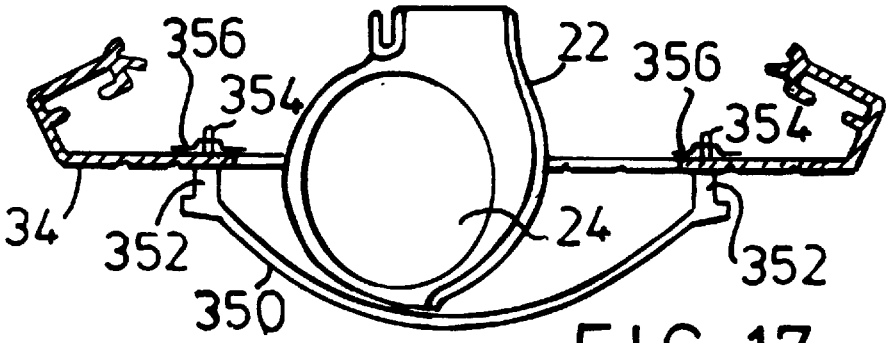
FIG. 17 is an end view of a ventilation system of the invention showing a second fixing means for a grill cover therefor.

In FIG. 17 a grill cover 350 is fixed to the ridge undercladding either side of its opening. The grill cover 350 has spaced upstanding spigots 352 provided with metal pins 354. The pins 354 fit through holes in the undercladding are fixed in place with star washer 356.

Figure 18:
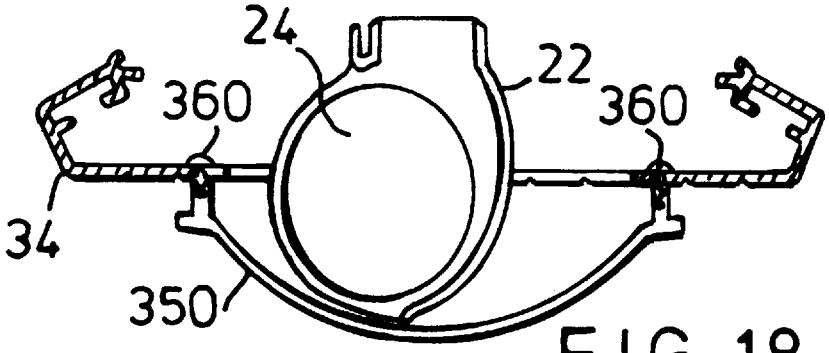
FIG. 18 is an end view of a ventilation system of the invention showing a third fixing member for a grill cover therefor.

FIG. 18 shows a variation on FIG. 17 which omits the pins 354 but uses the spigots 352 to receive screws 360 from the opposite of the undercladding.

Figure 19:
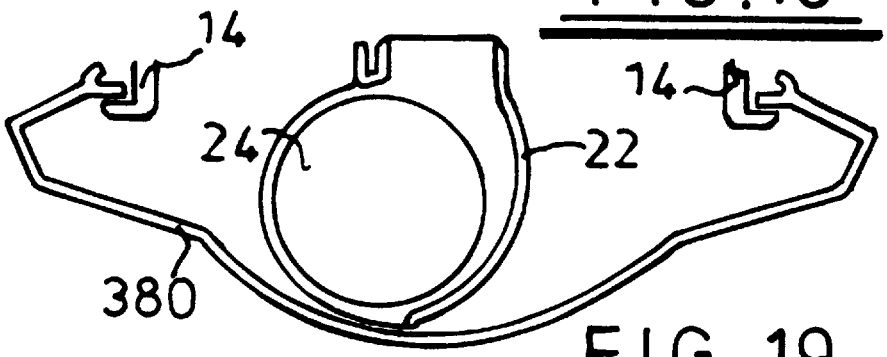
FIG. 19 is an end view of a ventilation system of the invention showing a fourth fixing means for a grill cover therefor.

In FIG. 19 instead of a separate grill cover and ridge undercladding, a one-piece undercladding with grill 380 may be attached to the ridge beam 10.

In the following description of FIGS. 20 to 27 like parts to those of the previous Figures and in FIGS. 20 to 27 have been given the same reference numbers for ease of understanding.

Figure 20:
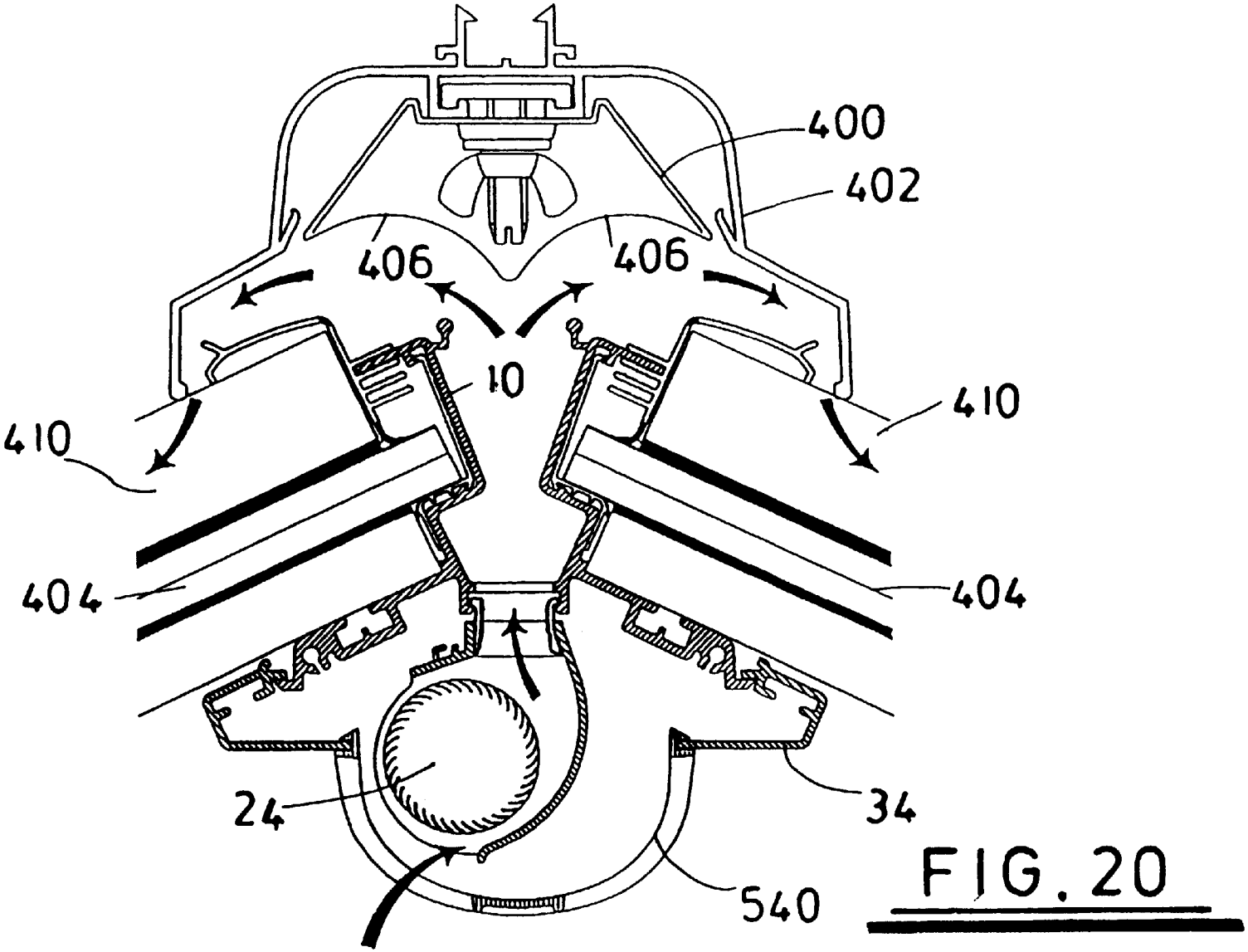
FIG. 20 is a section through a conservatory roof ridge with a ventilation system similar to that of FIG. 1 with variations.

Turning to FIG. 20, there is shown addition to the embodiment of FIG. 1 of the drawings of an air deflector 400 mounted on the underside on the ridge capping 402 which is in turn mounted on the ridge beam 10 with its side overlapping glazing 404. The deflector 400 provides a pair of arcuate concave surfaces 406 meeting centrally of the ridge. Air delivered by the fan 24 up through the ridge will be deflected left or right by the deflector towards edges of the ridge capping. The edges of the ridge capping rest on glazing bars 410, so that the air can escape under the capping edges between the glazing bars.

Figure 21:
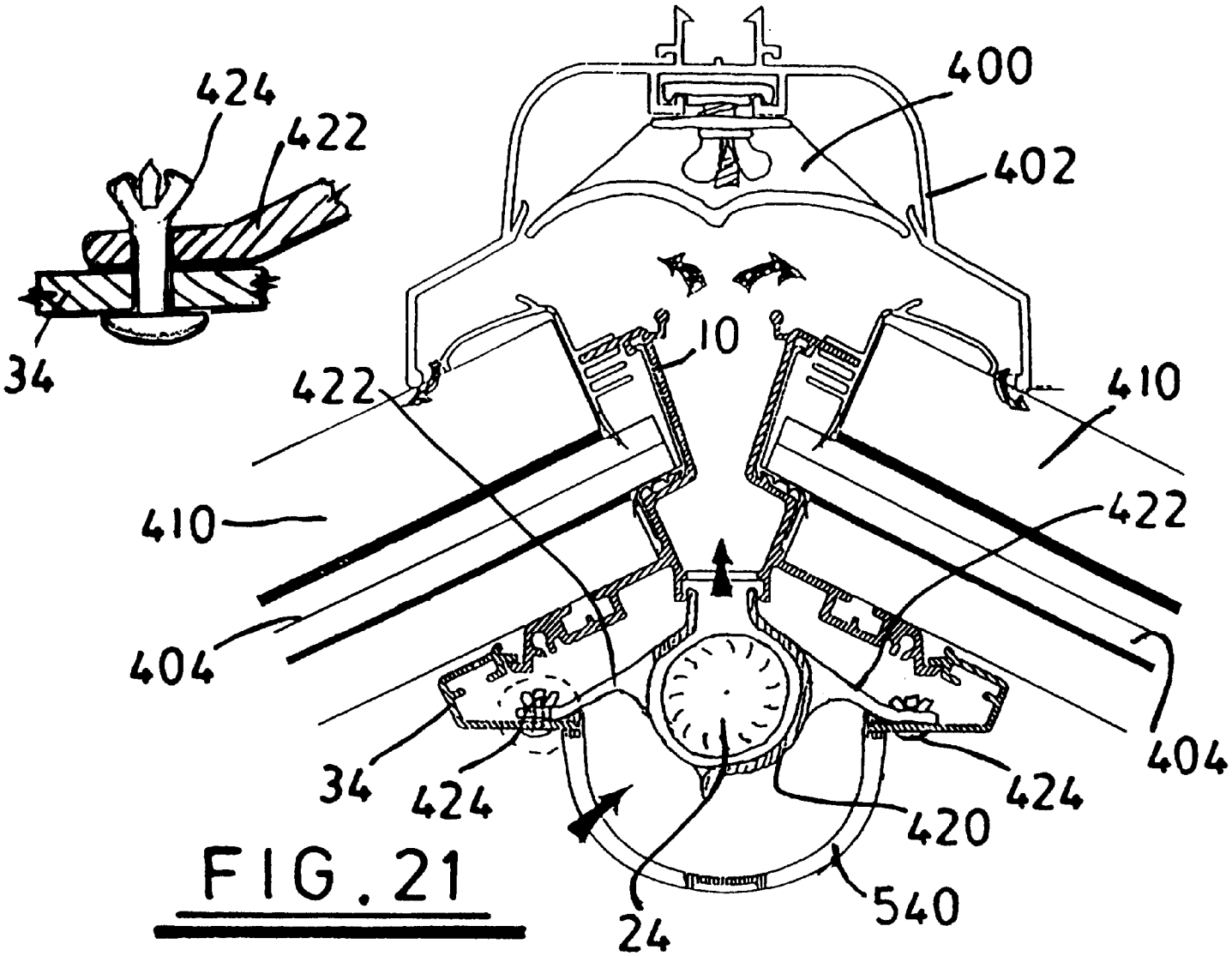
FIG. 21 is a section through a conservatory roof ridge showing another way of providing a ventilation system.
Figure 22:
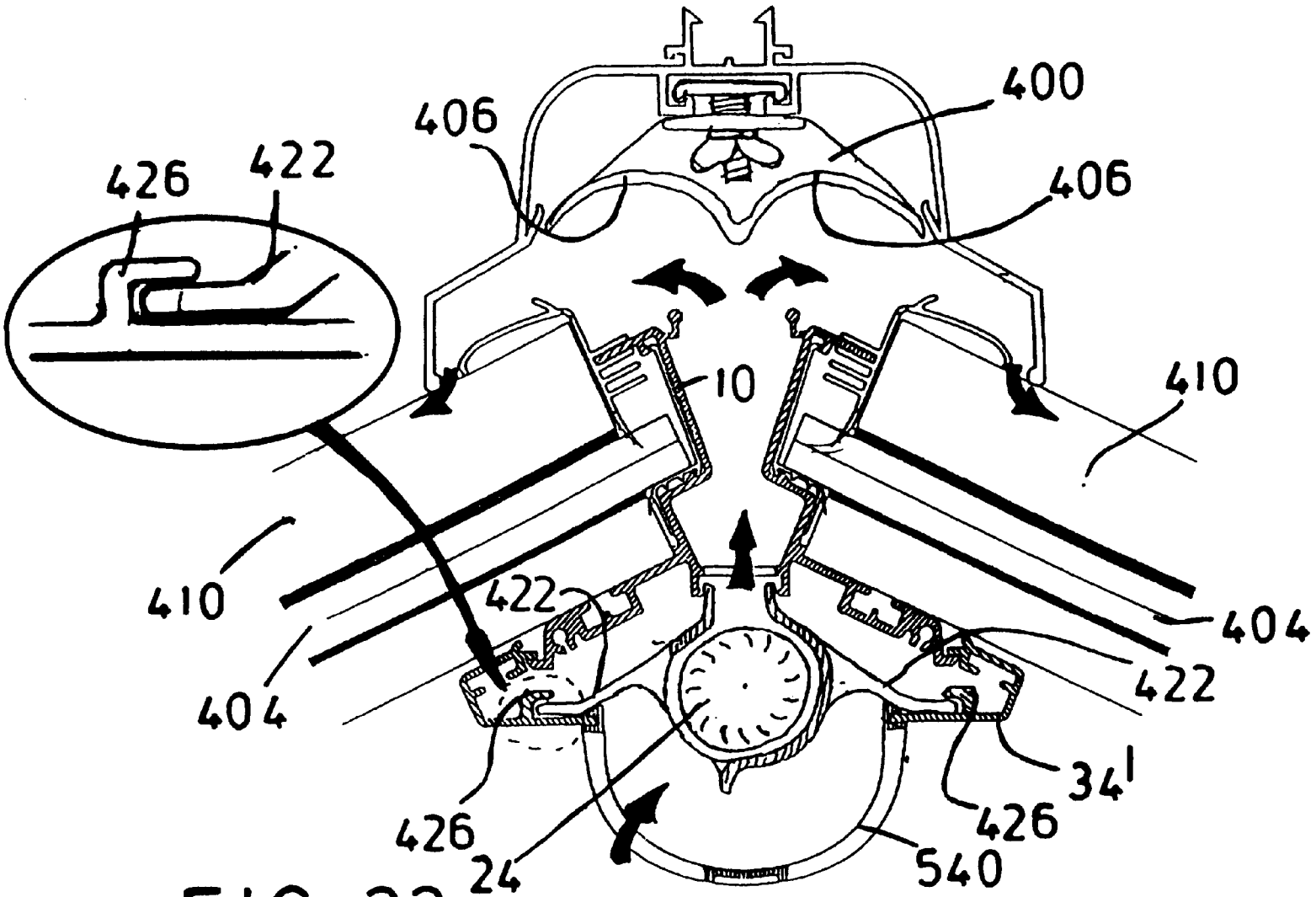
FIG. 22 shows a variation on FIG. 21.

In FIGS. 21 and 22 instead of the cowl for the horizontal axis fan rotor being mounted to the ridge beam it is mounted to undercladding 34. In FIG. 21, the cowl 420 has a pair of wings 422 one from each side that are secured to the undercladding by means of push rivets 424. In FIG. 22, ends of the wings 422 slide into channel slots 426 provided on the upper surface of undercladding 34'.

FIGS. 23 to 27 show a variation of the invention, in which cowl 500 for a ventilation unit having a fan rotor on a horizontal axis is mounted on the underside of ridge capping 402. The cowl 500 has an air inlet 502 in its underside that is extended by means of a tube 504 with a flared opening 506 through the ridge beam 10. The cowl has an air outlet 508 that extends slightly downwardly from a side of the cowl. The outlet 508 is angled to direct air towards an edge of the ridge capping 402 so that the air can escape under the edge of the ridge capping between glazing bars 410.

Figure 23:
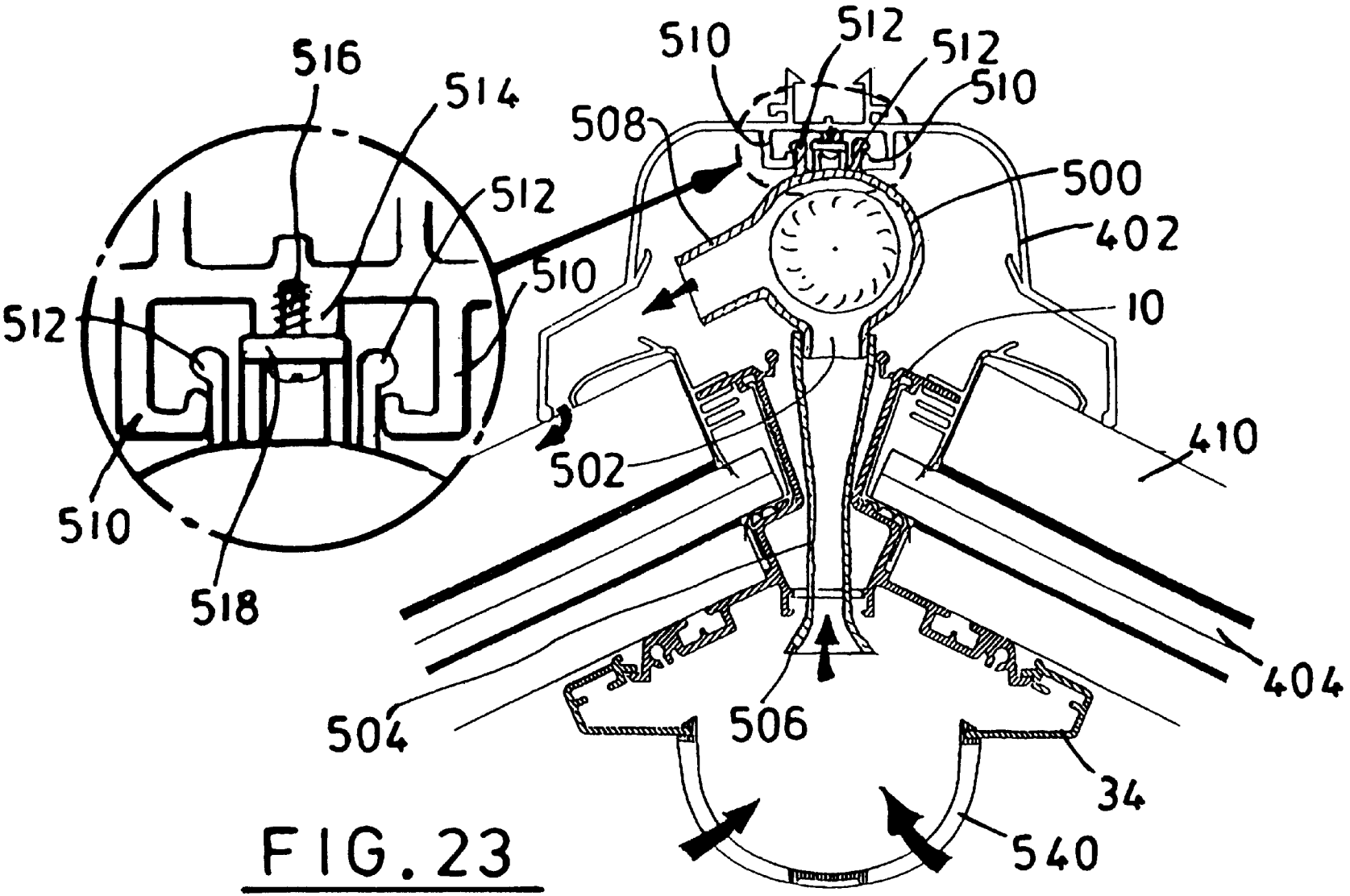
FIG. 23 is a section through a conservatory roof ridge showing yet another way of providing a ventilation system.
Figure 25:
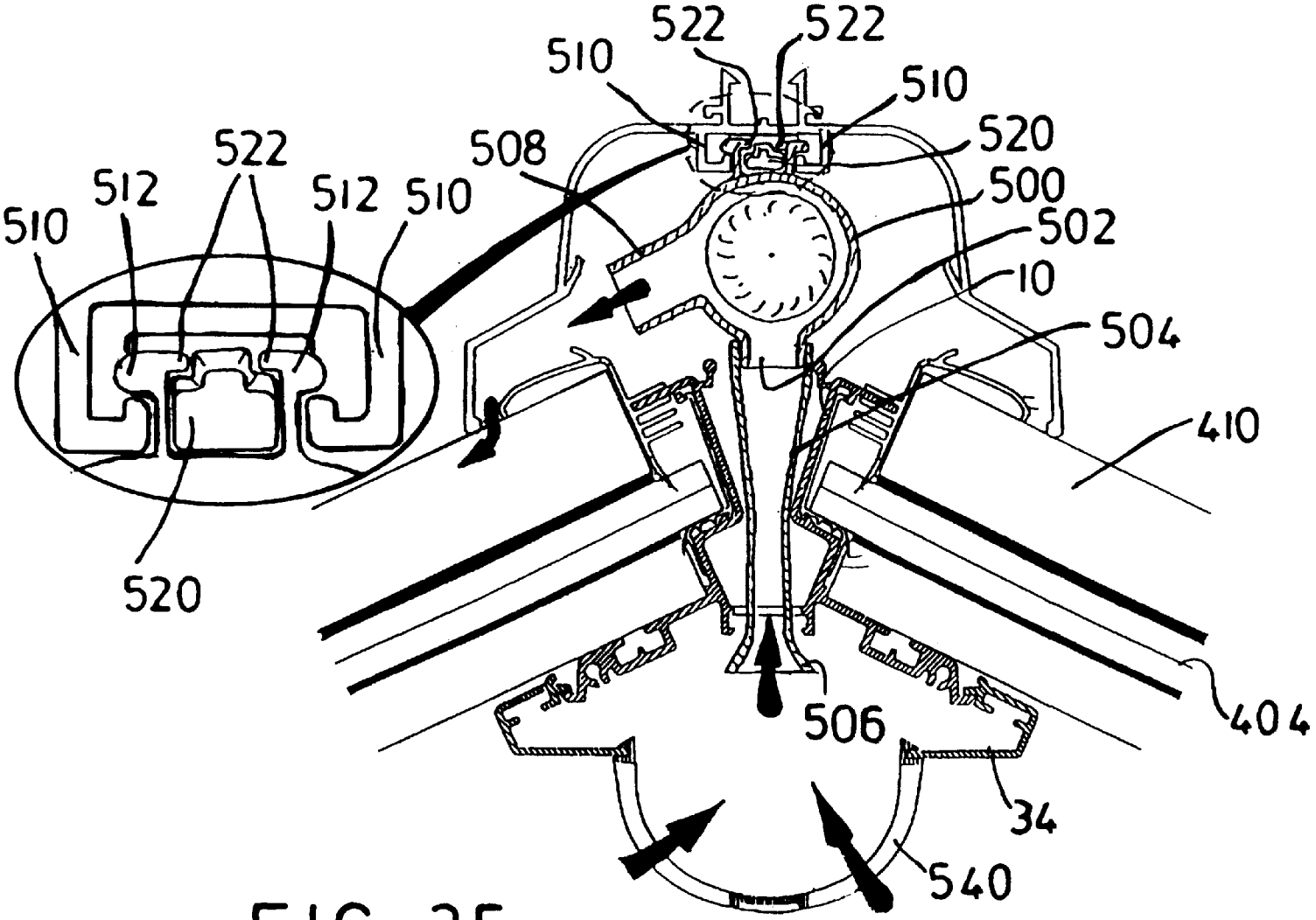
FIG. 25 shows another variation on FIG. 23.
Figure 26:
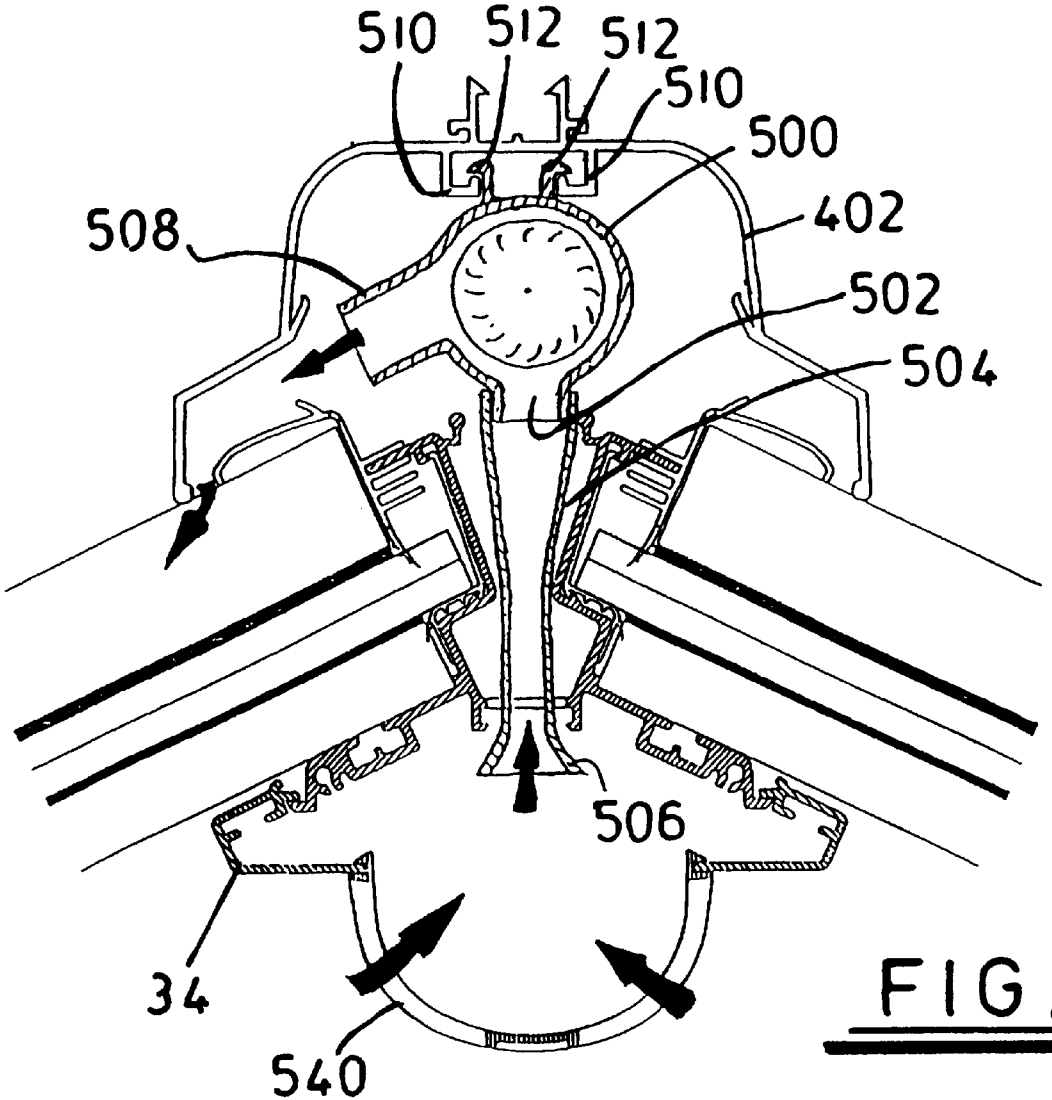
FIG. 26 shows a further variation on FIG. 23.

The underside of the ridge capping 402 has a pair of facing L-shaped ribs 510 and in FIGS. 23, 25 and 26 the cowl top has a pair of upstanding clip members 512 that engage ribs 510 when the cowl is pushed up to the capping. In FIG. 26 that is the only fixing for the cowl but in FIG. 23 the ridge capping has a screw port 514 between the ribs 510 to receive a securing screw 516 through a tab 518 of the cowl.

In FIG. 25 securement of the cowl to the capping is enhanced by a wedge member 520 inserted between the clips 512, which for that purpose have facing lips 522 beneath which edges of the wedge fit.

Figures 24A, 24B, 24C:
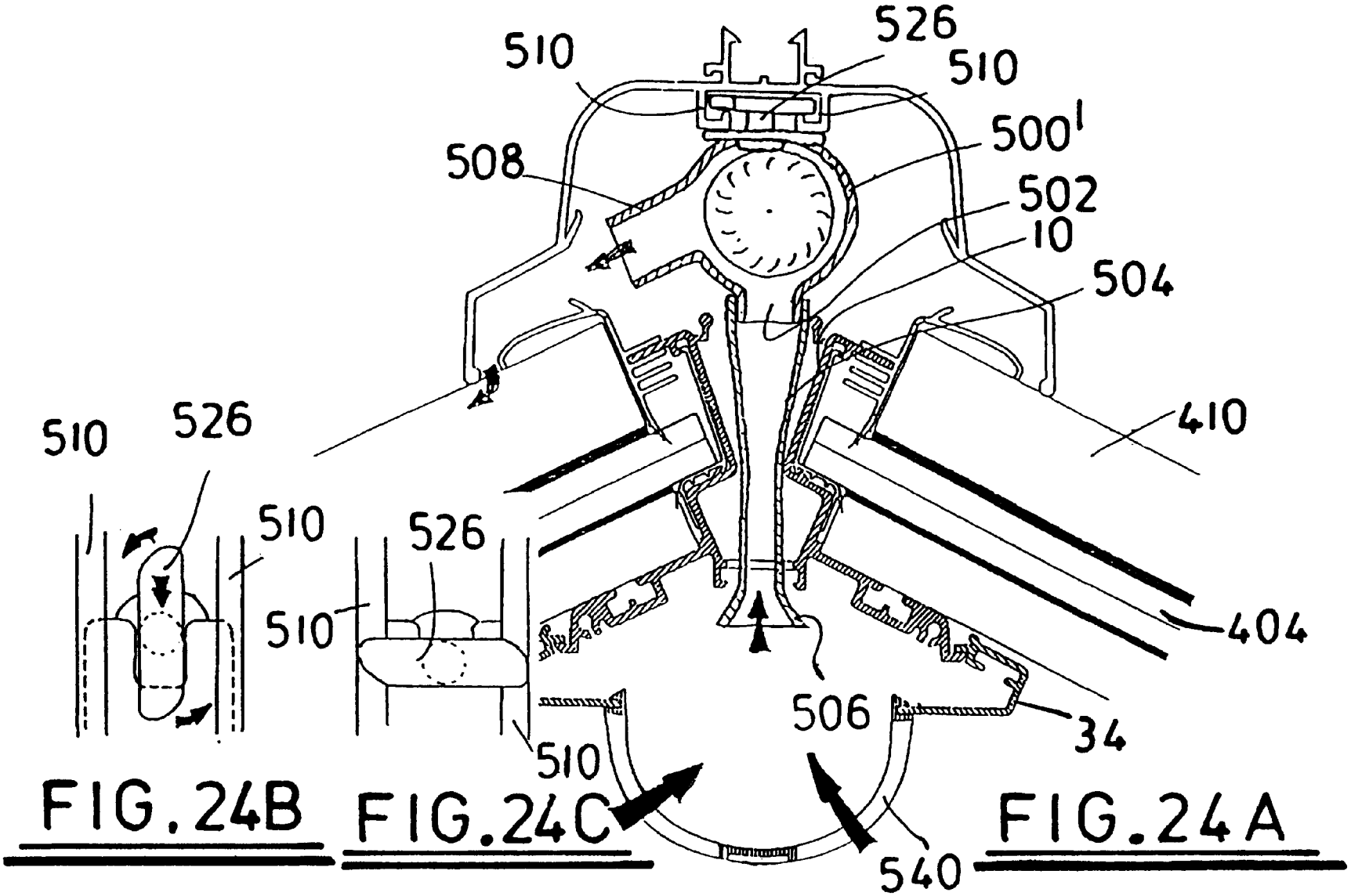
FIGS. 24A, 24B and 24C shows a variation of FIG. 23.

In FIG. 24A fan cowl 500' has T-bolt fixing 526 wherein the head of the bolt in one direction parallel to the ridge can be fitted between ribs 510 and then turned through 90° to be retained between the ribs and the capping, as shown respectively in FIGS. 24B and C.

Figure 27:
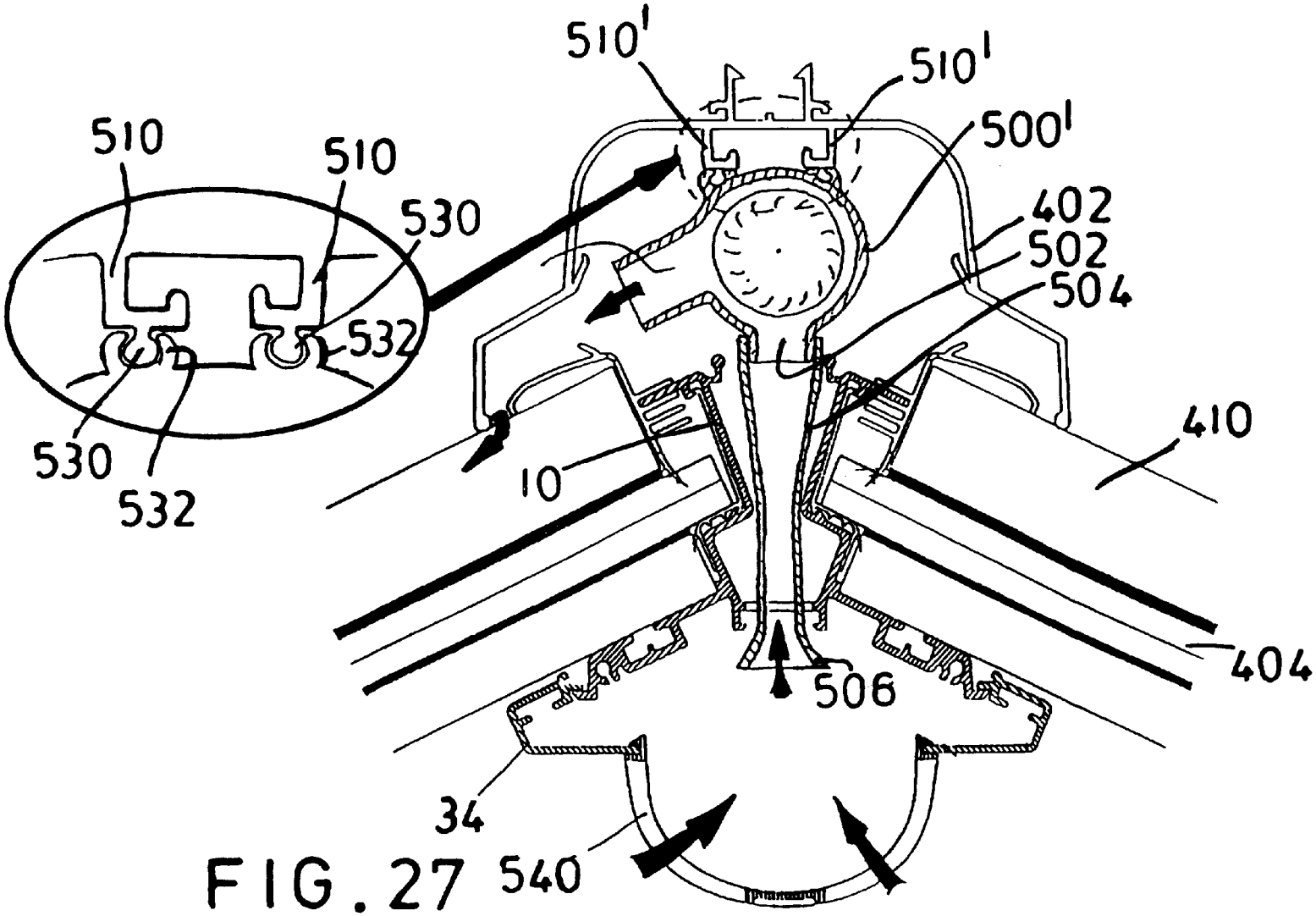
FIG. 27 shows a yet further variation on FIG. 23.

Finally, in FIG. 27, on the underside of ribs 510' of capping 402' are ball shaped projections 530 that snap fit into corresponding sockets 532 of cowl 500".

In all of the embodiments of FIGS. 20 to 27 an arcuate section grill 540 is shown fitted to an opening in ridge undercladding 34.

What is claimed is:

1. A roof ventilation system, especially for a conservatory roof, comprising a cowl attachable to a ridge component of the roof and an electrically operated rotor within the cowl, wherein the cowl has pairs of formations on end extension that can locate on the underside of the ridge component and wherein wedges are provided for insertion between said formations to urge said formations outwards to hold said formations in place.

2. A roof ventilation system, especially for a conservatory roof, comprising a cowl attachable to a ridge component of the roof and an electrically operated rotor within the cowl, wherein the cowl has rotatable clips on end extensions of the cowl that can rotate through 90° to locate in formations on the underside of the ridge component.

3. A roof ventilation system, especially for a conservatory roof, comprising a cowl attachable to a ridge component of the roof, an electrically operated rotor within the cowl, and a mounting plate for fixing on the underside of the ridge component, wherein, as means for mounting the cowl on the mounting plate, the mounting plate has a pair of facing grooves to receive tongue formations of the cowl in sliding fashion.

4. A roof ventilation system, especially for a conservatory roof, comprising a cowl attachable to a ridge component of the roof, an electrically operated rotor within the cowl, and a mounting plate for fixing on the underside of the ridge component, wherein, as means for mounting the cowl on the mounting plate, the mounting plate has shaped formations to snap-fit correspondingly shaped formations of the cowl.

5. A system as claimed in any one of claims 1, 2, 3, and 4, wherein the rotor is arranged to rotate on a generally horizontal axis.

6. A system as claimed in any one of claims 1, 2, 3, and 4 further comprising an apertured cover for concealing the rotor from below.

7. A system as claimed in claim 6, wherein the apertured cover is in the form of a grill with apertures in the form of slots.

8. A system as claimed in claim 6, wherein the apertured cover is attachable to undercladding for the ridge component.

9. A system as claimed in claim 8, wherein the apertured cover is attachable over an opening in the undercladding.

10. A system as claimed in claim 9, wherein the apertured cover has side apertures.

11. A system as claimed in any one of claims 1, 2, 3, and 4, wherein the cowl locates the rotor in an offset position relative to the roof ridge component and has sides extending above the rotor.

12. A conservatory roof ridge having a ventilation system mounted thereon, the ventilation system comprising a cowl attached to a ridge component of the roof, an electrically operated rotor within the cowl, the cowl locating the rotor in an offset position relative to the roof ridge and having sides extending above the rotor, wherein, as means for attaching the cowl to the underside of the ridge, the cowl sides have outwardly directed barbs located on ribs on the ridge component underside.

13. A conservatory roof ridge having a ventilation system mounted thereon, the ventilation system comprising a cowl attached to a ridge component of the roof, an electrically operated rotor within the cowl, the cowl locating the rotor in an offset position relative to the roof ridge and having sides extending above the rotor, wherein, as means for attaching the cowl to the underside of the ridge, the cowl has pairs of formations on end extensions that are located on the underside of the ridge component and wedges are inserted between said formations to urge said formations outwards to hold said formations in place.

14. A conservatory roof ridge having a ventilation system mounted thereon, the ventilation system comprising a cowl attached to a ridge component of the roof, an electrically operated rotor within the cowl, the cowl locating the rotor in an offset position relative to the roof ridge and having sides extending above the rotor, wherein, as means for attaching the cowl to the underside of the ridge, the cowl has rotatable clips on end extensions of the cowl that can rotate through 90° to locate in formations on the underside of the ridge component.

15. A conservatory roof ridge having a ventilation system mounted thereon, the ventilation system comprising a cowl attached to a ridge component of the roof, an electrically operated rotor within the cowl, the cowl locating the rotor in an offset position relative to the roof ridge and having sides extending above the rotor, wherein, as means for attaching the cowl to the underside of the ridge, the roof ridge further comprises a mounting plate on the underside of the ridge component, the cowl being mounted on the mounting plate, wherein the mounting plate has a pair of facing grooves and receives tongue formations of the cowl in sliding fashion.

16. A conservatory roof ridge having a ventilation system mounted thereon, the ventilation system comprising a cowl attached to a ridge component of the roof, an electrically operated rotor within the cowl, the cowl locating the rotor in an offset position relative to the roof ridge and having sides extending above the rotor, wherein, as means for attaching the cowl to the underside of the ridge, the roof ridge further comprises a mounting plate on the underside of the ridge component, the cowl being mounted on the mounting plate, wherein the mounting plate has shaped formations snap-fitted into correspondingly shaped formations of the cowl.

17. A conservatory roof ridge having a ventilation system mounted thereon, the ventilation system comprising a cowl attached to a ridge component of the roof, an electrically operated rotor within the cowl, the cowl locating the rotor in an offset position relative to the roof ridge and having sides extending above the rotor, means for attaching the cowl to the underside of the ridge, and an air deflector counted on the underside of a ridge capping, wherein the deflector presents a pair of concave arcuate surfaces, one on each side of the ridge.

18. A roof ridge as claimed in any one of claims 12, 13, 15, 16, and 17 wherein the rotor is arranged to rotate on a generally horizontal axis.

19. A roof ridge as claimed in any one of claims 12, 13, 15, 16, and 17 further comprising an apertured cover for concealing the rotor from below.

20. A roof ridge as claimed in claim 19, wherein the apertured cover is in the form of a grill with apertures in the form of slot.

21. A roof ridge as claimed in claim 19, wherein the apertured cover is attached to undercladding for the ridge.

22. A roof ridge as claimed in claim 21, wherein the apertured cover is attached over an opening the in the undercladding.

23. A roof ridge as claimed in claim 22, wherein the apertured cover has side apertures.

* * * * *

UNITED STATES PATENT AND TRADEMARK OFFICE

CERTIFICATE OF CORRECTION

PATENT NO. : 6,185,880 B1
DATED : February 13, 2001
INVENTOR(S) : Christopher Richardson It is certified that error appears in the above-identified patent and that said Letters Patent is hereby corrected as shown below:

Column 1,
Line 25, after the word "roof", insert the word -- and --.
Line 63, the word "while" should read -- when --.

Column 2,
Line 23, the word "present" should read -- presents --.
Line 31, delete the words "that be".
Line 49, the word "provides" should read -- provided --.

Column 5,
Line 1, after the word "shown", insert the word -- an --.
Line 57, the word "extension" should read -- extensions --.

Column 8,
Line 19, after the word "opening", delete the word "the".

Signed and Sealed this

Thirtieth Day of October, 2001

*Attest:*

Nicholas P. Godici

NICHOLAS P. GODICI
*Acting Director of the United States Patent and Trademark Office*

*Attesting Officer*